US011634255B1

(12) United States Patent
Hazelton et al.

(10) Patent No.: US 11,634,255 B1
(45) Date of Patent: Apr. 25, 2023

(54) CONDIMENT BOTTLE

(71) Applicant: Helen of Troy Limited, St. Michael (BB)

(72) Inventors: Lance E. Hazelton, Maplewood, NJ (US); Nicholas Reynolds, New York, NY (US); Dan Juda, Brooklyn, NY (US)

(73) Assignee: Helen of Troy Limited, St. Michael (BB)

( * ) Notice: Subject to any disclaimer, the term of this patent is extended or adjusted under 35 U.S.C. 154(b) by 0 days.

(21) Appl. No.: 17/504,865

(22) Filed: Oct. 19, 2021

(51) Int. Cl.
*B65D 47/08* (2006.01)
*B65D 53/04* (2006.01)

(52) U.S. Cl.
CPC ..... *B65D 47/0857* (2013.01); *B65D 53/04* (2013.01)

(58) Field of Classification Search
CPC ... B65D 47/0857; B65D 53/04; B65D 47/122
See application file for complete search history.

(56) References Cited

U.S. PATENT DOCUMENTS 610,557 A * 9/1898 Noera ..... B65D 35/42 220/811
4,394,918 A 7/1983 Grussen
5,114,044 A * 5/1992 Spanek, Jr. ..... A21C 15/005 383/906
7,591,398 B2 9/2009 Pritikin
8,127,971 B1 * 3/2012 Chininis ..... A21C 15/005 222/326
8,544,685 B2 10/2013 Swanick
9,010,575 B2 * 4/2015 Read ..... A23G 3/28 222/107
2006/0180585 A1 8/2006 Cunningham
2019/0127130 A1 * 5/2019 Ban ..... B65D 47/122
2020/0017260 A1 1/2020 Migas

FOREIGN PATENT DOCUMENTS

WO 2021028167 2/2021

* cited by examiner

*Primary Examiner* — Donnell A Long
(74) *Attorney, Agent, or Firm* — Rankin, Hill & Clark LLP

(57) ABSTRACT

A condiment bottle includes a container and cap assembly. The cap assembly includes a securing part releasably connected to the container, a nozzle secured to the container by the securing part, and a closure part connected to both the securing part and the nozzle. The closure part is configured to move along a longitudinal axis of the condiment bottle from a closed position where the closure part sealingly engages the nozzle to an intermediate position where the closure part is spaced from and covering the top of the nozzle. The closure part is further configured to pivotally move from the intermediate position to an open position where the closure part is located along a sidewall of the nozzle.

18 Claims, 15 Drawing Sheets

CONDIMENT BOTTLE

BACKGROUND

Reclosable dispensing closures have been employed with a wide variety of products, including condiment bottles. The dispensing closure can be opened and closed without removing or separating any portion of the dispensing closure from the container. There are several styles of dispensing closures currently commercially available. For example, pull/push and screw type are two common designs. In both of these popular designs, the common theme is that there is a base connected to the container and a spout installed together in an assembly. A disadvantage of these designs is that opening and closing of the dispending closure is not consistent because of manufacturing and assembly irregularities.

SUMMARY

According to one aspect, a condiment bottle comprises a container and cap assembly. The cap assembly includes a securing part releasably connected to the container, a nozzle secured to the container by the securing part, and a closure part connected to both the securing part and the nozzle. The closure part is configured to move along a longitudinal axis of the condiment bottle from a closed position where the closure part sealingly engages the nozzle to an intermediate position where the closure part is spaced from and covering the top of the nozzle. The closure part is further configured to pivotally move from the intermediate position to an open position where the closure part is located along a sidewall of the nozzle.

According to another aspect, a method of dispensing a substance from a container is disclosed. The method comprises providing a container having a cap assembly associated therewith, wherein the cap assembly includes a securing part connected to the container, a nozzle secured by the securing part, and a closure part connected to both the securing part and the nozzle; moving the closure part axially along a longitudinal axis of the container from a closed position of the closure part where the closure part sealingly engages the nozzle to an intermediate position of the closure part where the closure part is spaced from and covering the nozzle; pivoting the closure part in the intermediate position away from the nozzle to an open position where the closure part no longer covers the nozzle; and dispensing the substance through an opening of the nozzle.

According to another aspect, a condiment bottle comprises a container and cap assembly. The cap assembly includes a securing part releasably connected to the container, a nozzle secured to the container by the securing part, and a closure part connected to both the securing part and the nozzle. The closure part is configured to move along a longitudinal axis of the condiment bottle from a closed position where the closure part sealingly engages the nozzle to an intermediate position where the closure part is spaced from and covering the nozzle. The closure part is further configured to pivotally move from the intermediate position to an open position where the closure part no longer covers the nozzle. The closure part includes a collar hingedly connected to the securing part and a cover secured by the collar. The cover is movable along the longitudinal axis from a first position where the closure part is in the closed position to a second position where the closure part is in the intermediate position.

DETAILED DESCRIPTION

Figure 1:
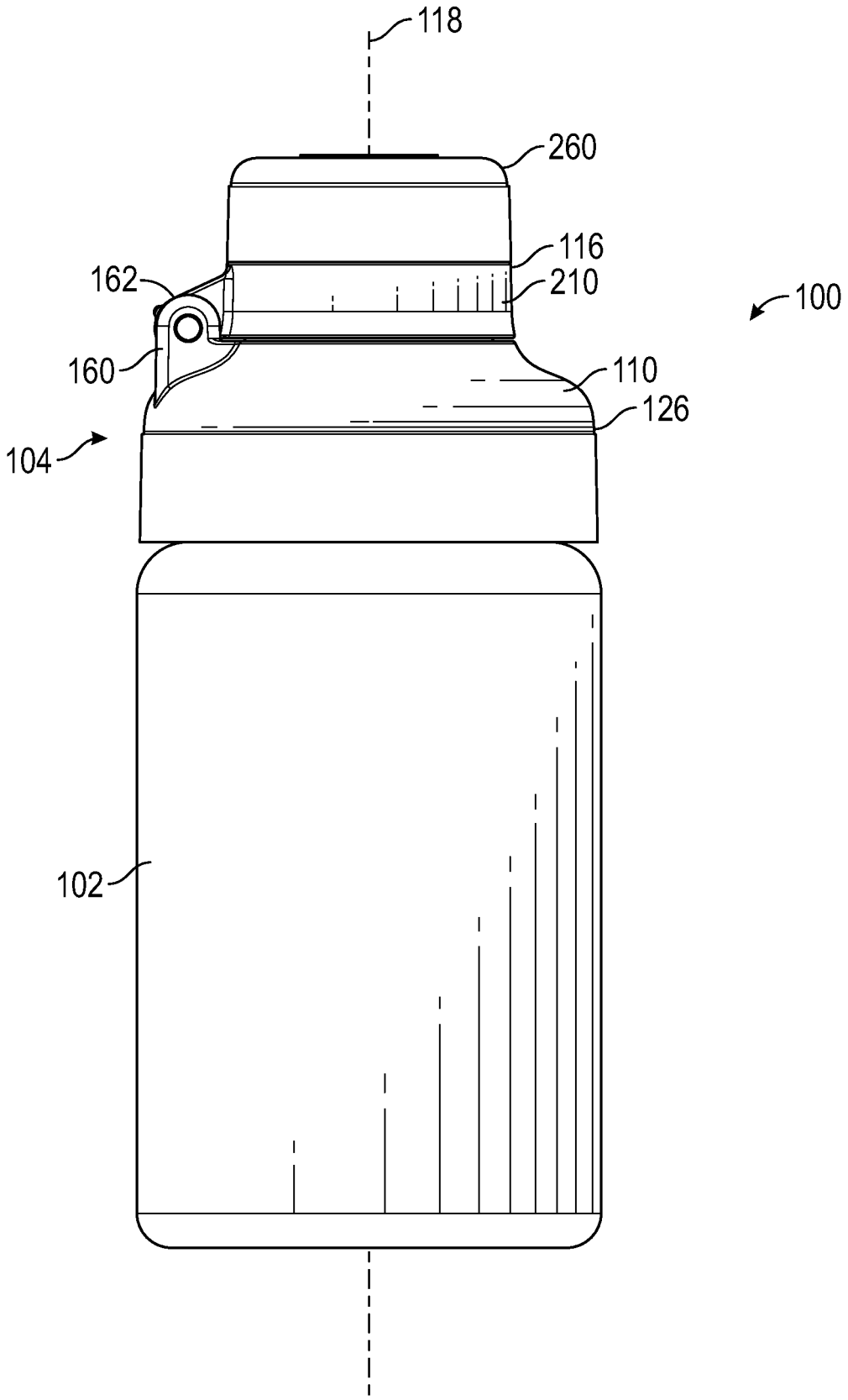
FIG. 1 is a side perspective view of a condiment bottle according to the present disclosure with a cap assembly in a closed position.

It should, of course, be understood that the description and drawings herein are merely illustrative and that various modifications and changes can be made in the structures disclosed without departing from the present disclosure. It should further be appreciated that any term of degree used herein, such as "substantially," means a reasonable amount of deviation of the modified word is contemplated such that the end result is not significantly changed.

Referring now to the drawings, wherein like numerals refer to like parts throughout the several views, FIGS. 1-5 illustrate an exemplary condiment bottle 100 according to the present disclosure. The condiment bottle 100 comprises a container (or bottle or other like vessel) 102 and cap assembly 104 engageable with an open neck portion 106 of the container 102. The cap assembly 104 includes a securing part 110 releasably connected to the container 102, a nozzle 112 secured to the container by the securing part, and a closure part 116 connected to both the securing part and the nozzle. The parts of the cap assembly 104 are assembled in a coaxial manner as described below. The closure part 116 is configured to move along a longitudinal axis 118 of the condiment bottle 100 from a closed position (FIG. 1) where the closure part 116 sealingly engages the nozzle 112 (for example, a top 120 of the nozzle) preventing fluid flow from the nozzle to an intermediate position (FIG. 2) where the closure part 116 is spaced from and covering the top of the nozzle 112. The closure part 116 is further configured to pivotally move from the intermediate position to an open position (FIG. 3) where the closure part 116 is located along a sidewall 122 of the nozzle 112 and a sidewall 126 of the securing part 110.

In FIGS. 5-8, the securing part 110 includes the sidewall 126, a first opening 130 at a top portion 132 of the sidewall 126, and a second opening 136 at a bottom portion 138 of the sidewall. The top portion 132 of the sidewall 126 can be substantially dome-shaped, and the bottom portion 138 of the sidewall can be substantially cylindrical shaped. An outer surface 140 of the bottom portion can be textured (for example, grooved or knurled) to provide for a gripping surface of the securing part 110. An inner surface 146 of the bottom portion 138 can include an internal thread 148 adapted to threadingly engage an external thread 152 on the neck portion 106 of the container 102. However, it should be appreciated that the securing part 110 could fit onto the neck portion 106 of the container in other conventional manners, for example, a snap or bayonet connection. The securing part 110 further includes a first hinge component 160 of a hinge 162 located on the top portion 132 for connection to the closure part 116 as will be described below.

Figure 16:
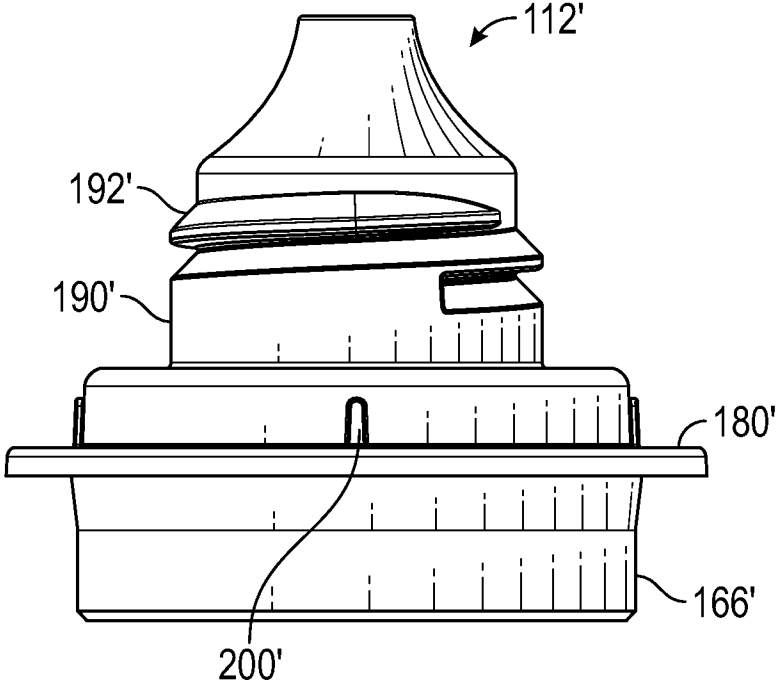
FIGS. 15 and 16 are side perspective views of the respective first nozzle and a second nozzle of the condiment bottle, a size of the second nozzle differing from a size of the first nozzle.
Figure 15:
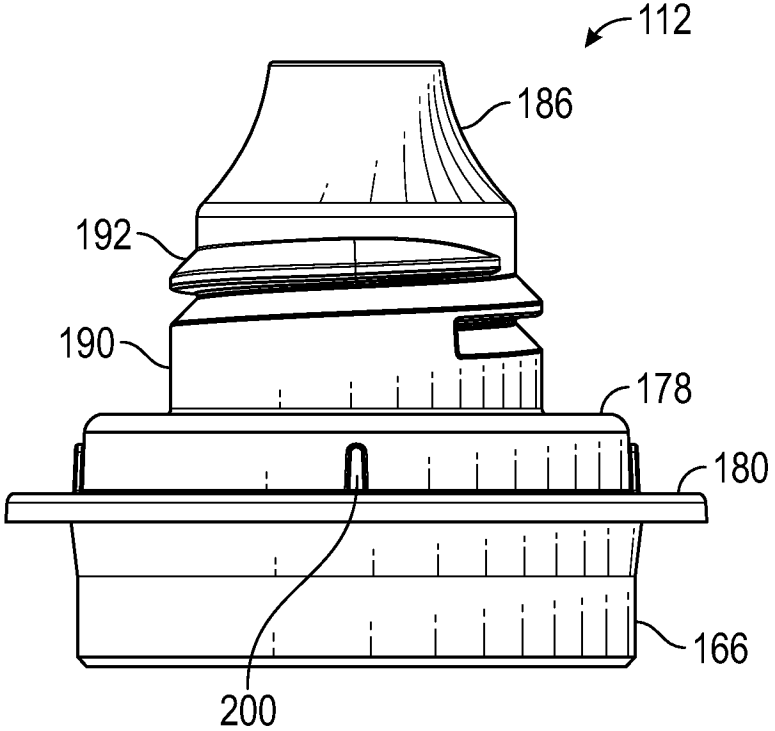

With reference to FIGS. 5, 6, 9 and 15, the nozzle 112 is configured to be secured between the neck portion 106 of the container 102 and the securing part 116. The nozzle 112 includes a sidewall 166 with an upper portion 168 and a lower portion 170. The lower portion 170 is sized to be fitted within the neck portion 106 and defines a lower inlet opening 172 for the nozzle, which is in fluid communication with the open neck portion 106 of the container 102. An annular platform 178 extends inwardly from the upper portion 168, and a mounting flange 180 extends outwardly from the upper portion 168. A spout 186 (which defines a fluid passage of the nozzle) projects outwardly from the platform 178 and includes an upper outlet opening 188 for the nozzle 112. In the depicted aspect, a sidewall 190 of the spout 186 (i.e., an outer wall of the nozzle) includes an external thread 192. To releasably hold the nozzle 112 within the securing part 110, the mounting flange 180 is secured between the neck portion 106 of the container 102 and the securing part 110; although, alternative manners for securing the nozzle 112 are contemplated. Further depicted in FIG. 8, the inner surface 142 of the sidewall 126 of securing part 110 near the top portion 132 includes first locating tabs 198, which in FIGS. 5 and 6 contact the mounting flange 180. The first locating tabs 198 can also abut second locating tabs 200 provided on the sidewall 166 of the nozzle 112 above the mounting tab 180. It should be appreciated that the closure part 116 is adapted to allow for nozzles of differing sizes. For example, the nozzle for the closure part 116 can be selected from one of a first nozzle (i.e., the nozzle 112 shown, for example, in FIGS. 9 and 15) having a first sized head part or spout 186 and a second nozzle 112' (FIG. 16) having a second sized head part or spout 186' that is smaller than the first sized head part or spout 186. in FIG. 16, the second nozzle 112' includes similar features, such as a mounting flange 180' extended from a sidewall 166', an external thread 192' on a sidewall 190' of the spout, and a second locating tab 200'.

Figure 3:
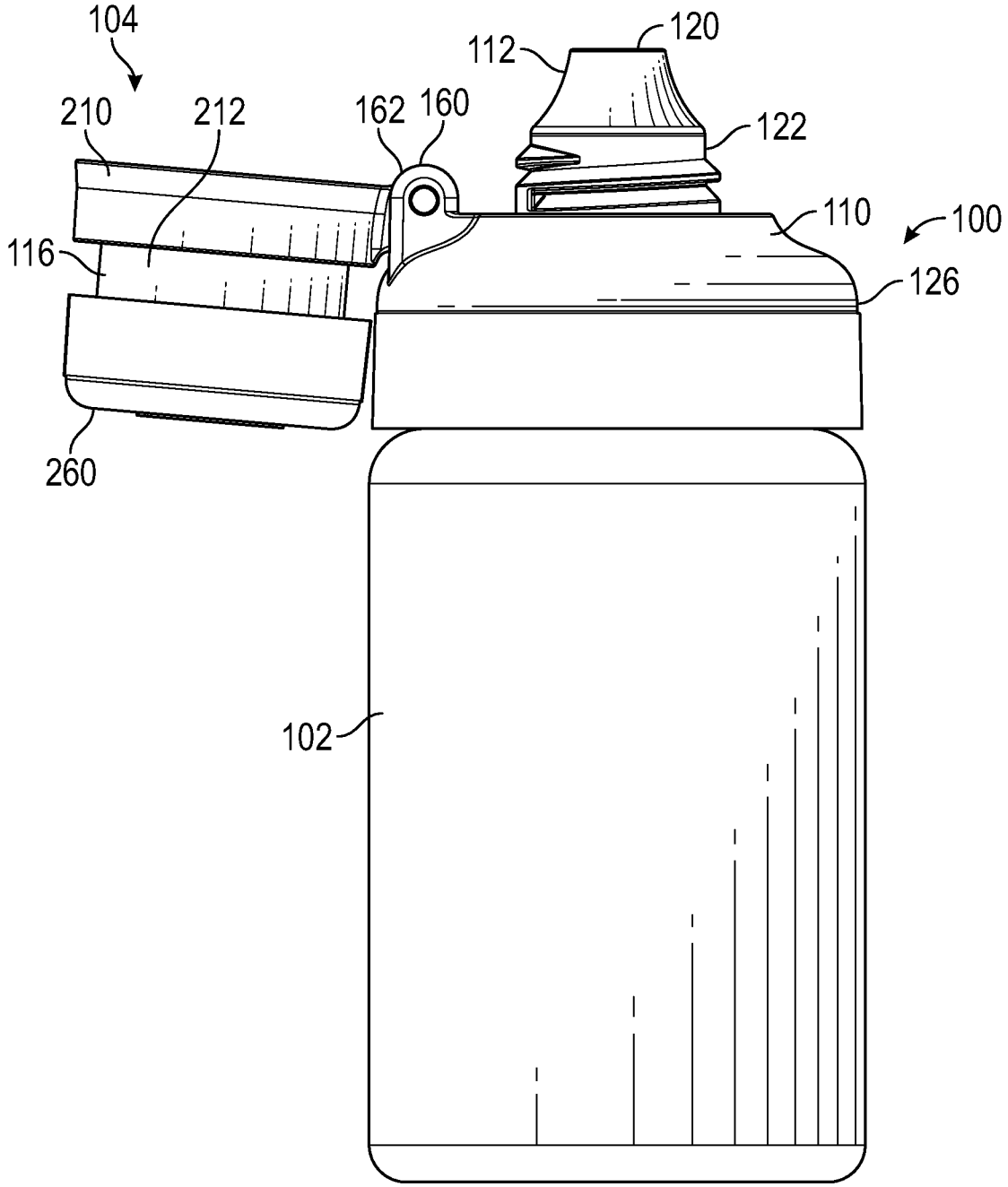
FIG. 3 is a side perspective view of the condiment bottle with the cap assembly in an open position.
Figure 4:
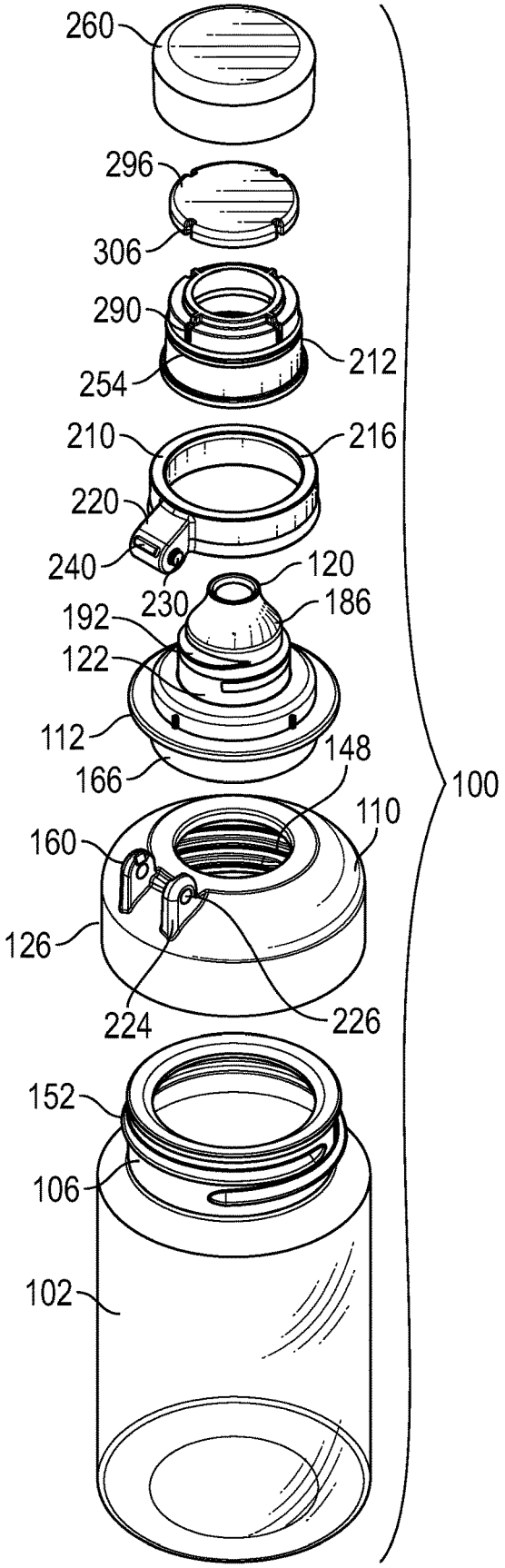
FIG. 4 is an exploded perspective view of the condiment bottle.
Figure 10:
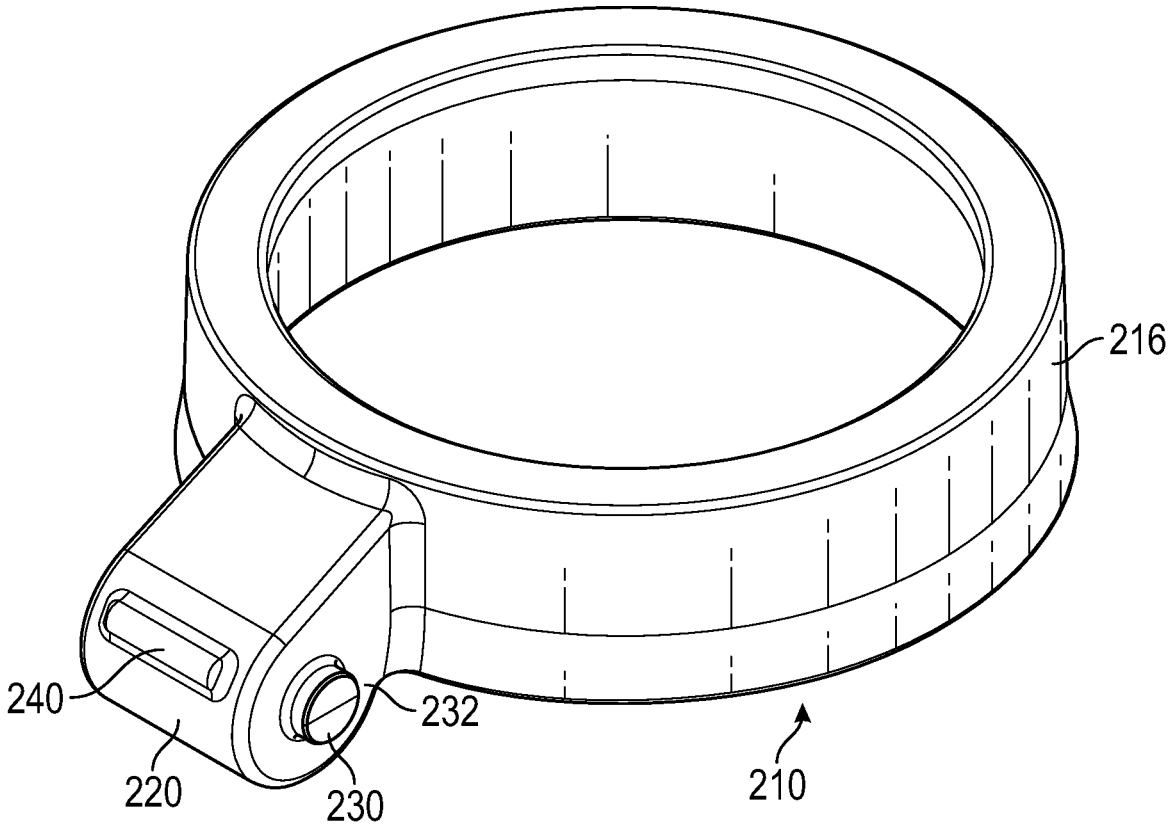
FIG. 10 is a top perspective view of a collar of the cap assembly.
Figure 11:
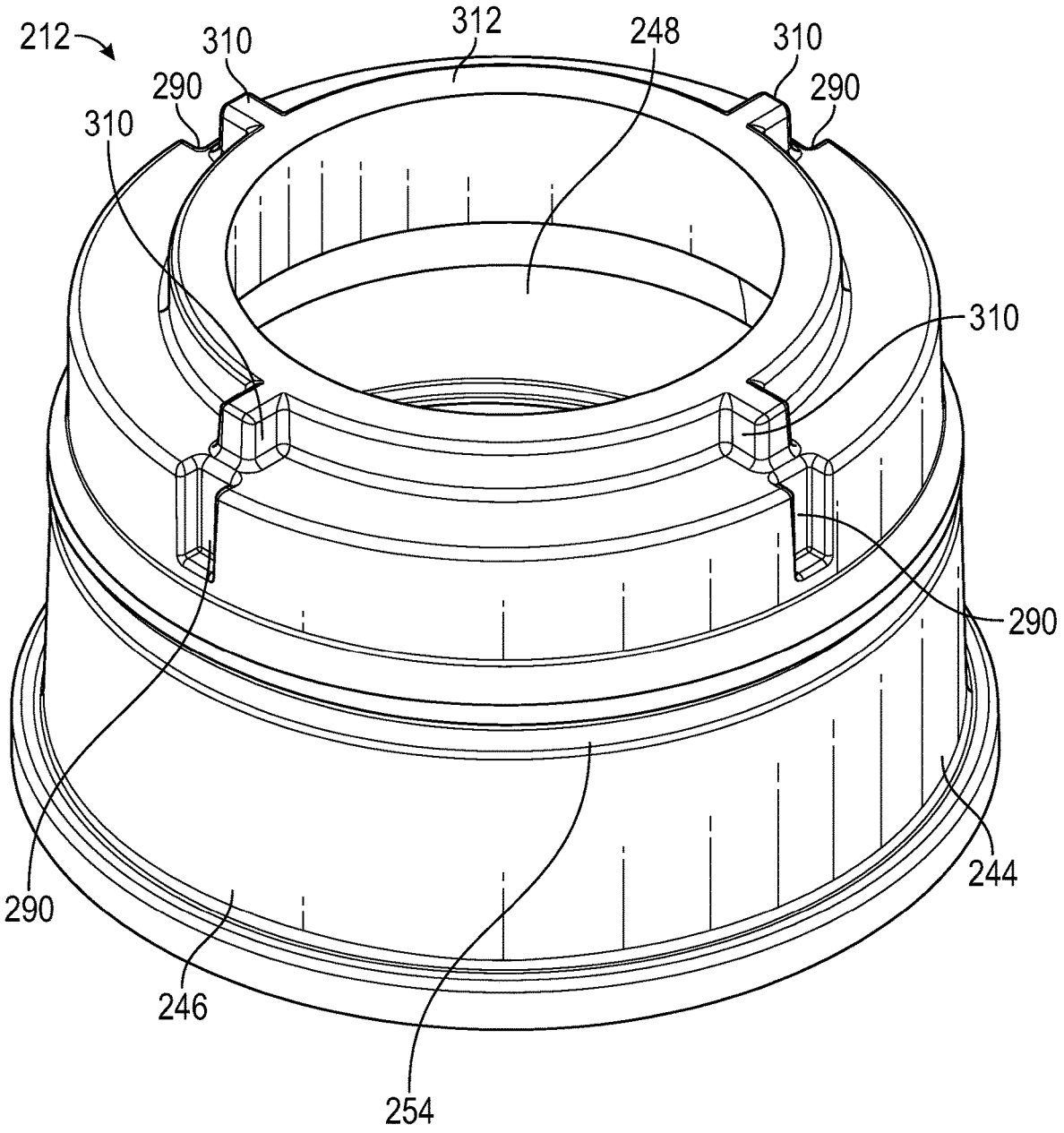
FIG. 11 is a side perspective view of a cover of the cap assembly.
Figure 12:
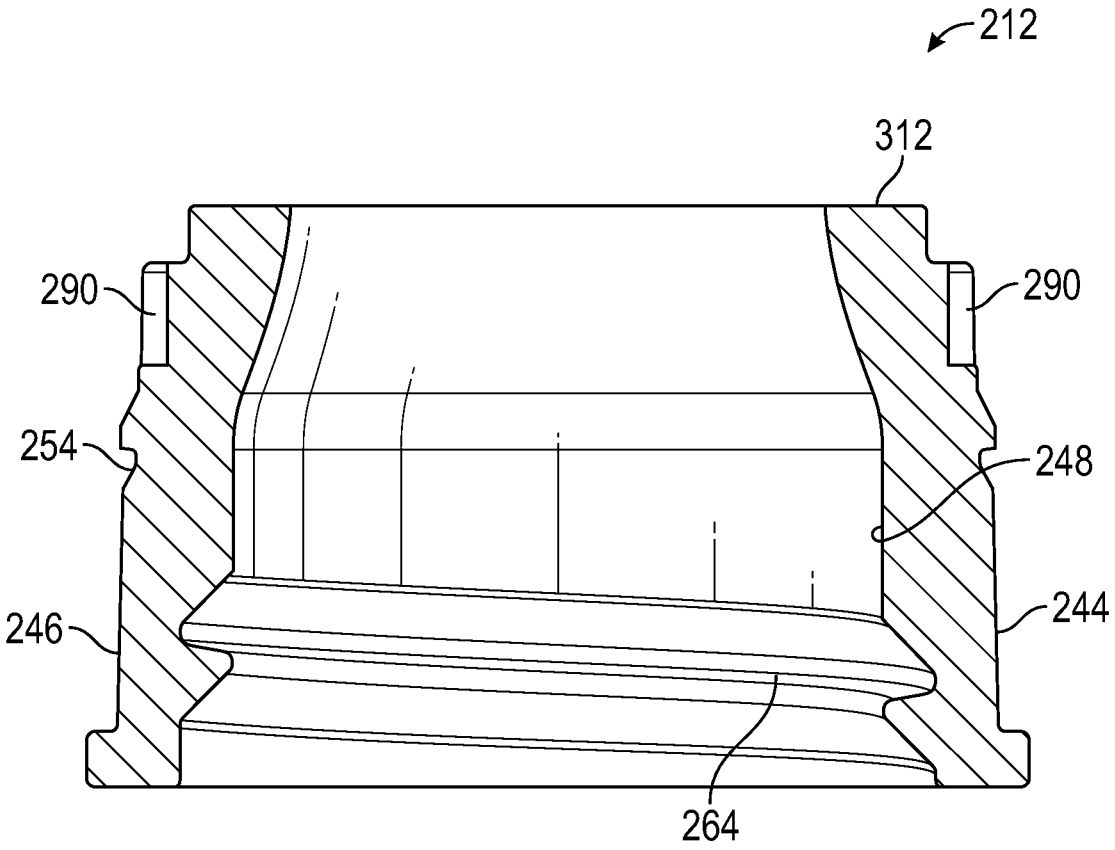
FIG. 12 is a cross-sectional view of the cover of the cap assembly.

The closure part 116 additionally includes a collar 210 and a cover 212 connected to the collar. As shown in FIGS. 4 and 10, the collar 210 includes a substantially ring shaped body 216 having extended thereon a second hinge component 220 of the hinge 162. The collar 210 is hingedly connected to the securing part 110 via the first and second hinge components 160, 200 of the hinge 162, and according to the present embodiment the hinged connection of the collar 210 and the securing part 110 is configured to maintain closure part 116 in the open position of FIG. 3. Particularly, in the depicted aspect of FIGS. 4, 7 and 10, the first hinge component 160 includes mounts 224 having openings 226 which receive pins 230 extended from opposite sides 232 of the second hinge component 220. The securing part 110 further includes a recess or notch 236 located between the mounts 224. The notch 236 is sized to received a bump or protuberance 240 provided on the second hinge component 220. Therefore, as the closing part 116 is pivoted from the intermediate position (FIG. 2) to the open position (FIG. 3) via the hinge 162, the bump or protuberance 240 on the second hinge component 220 is moved into the recess or notch 236 on the securing part 110, and this, in turn, maintains the closure part 116 in the open position during dispensing of a fluid from the condiment bottle 100.

Figure 2:
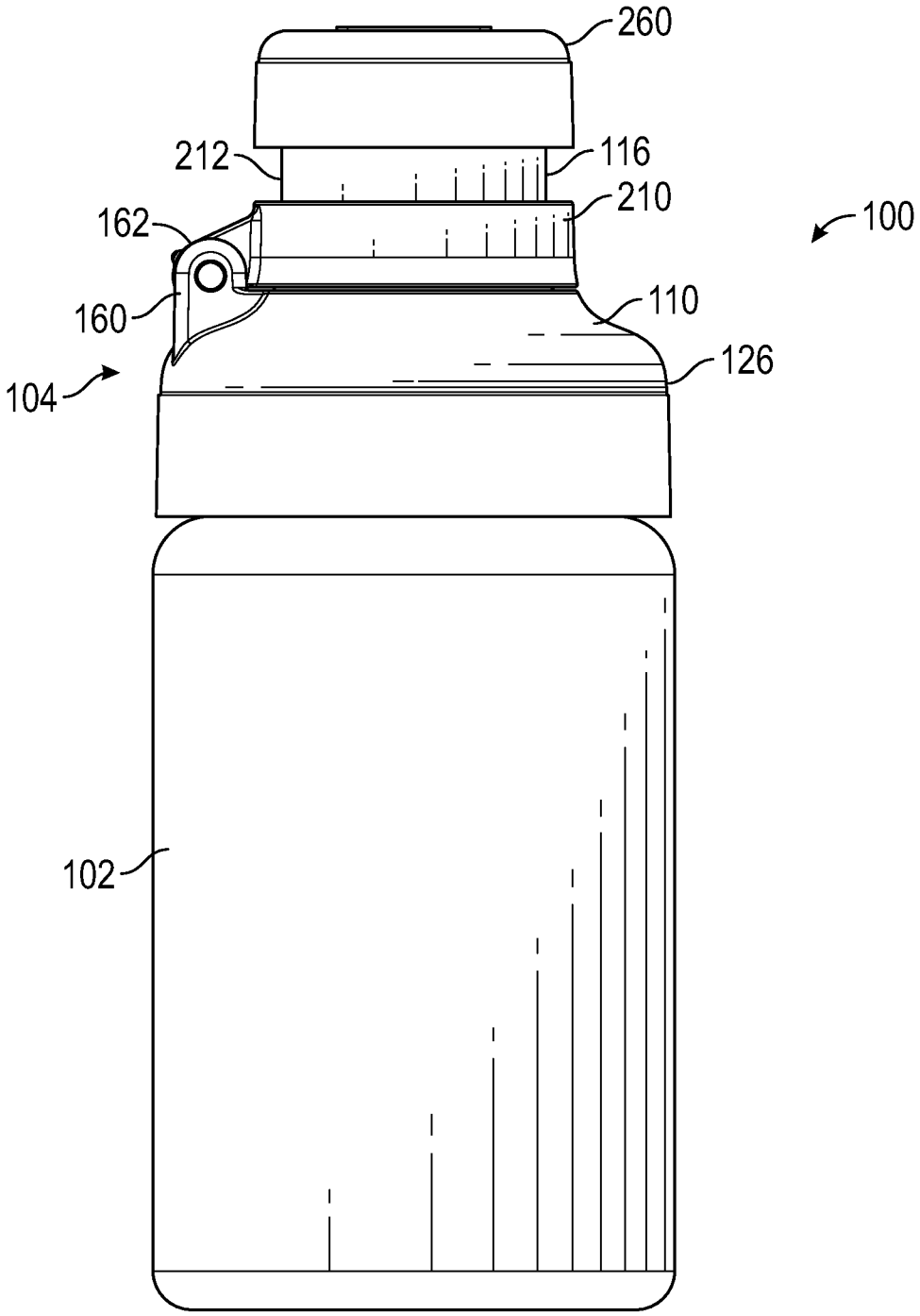
FIG. 2 is a side perspective view of the condiment bottle with the cap assembly in an intermediate position.

With reference to FIGS. 5, 6, 11 and 12, the cover 212 includes a substantially cylindrical shaped sidewall 244 with an outer surface 246 and an inner surface 248. An annular groove 254 is provided on the outer surface 246 for connection of a cap 260. The inner surface 248 is provided with an internal thread 264 for threadingly engaging the external thread 192 of the nozzle 112. This threaded arrangement between the cover 212 and the nozzle 112 allows the cover 212 to rotate with respect to the collar 210 about the longitudinal axis 118 and move relative to and along a length direction of the nozzle 112 (i.e., along the longitudinal axis 118) from a first position where the closure part 116 is in the closed position (FIG. 1) to a second position where the closure part 116 is in the intermediate position (FIG. 2). It should be appreciated that in the intermediate position, the cover 212 is no longer threadingly engaged to the nozzle 112 which allows the closure part 116 to pivot about the hinge 162 to the open position (FIG. 3).

Figure 6:
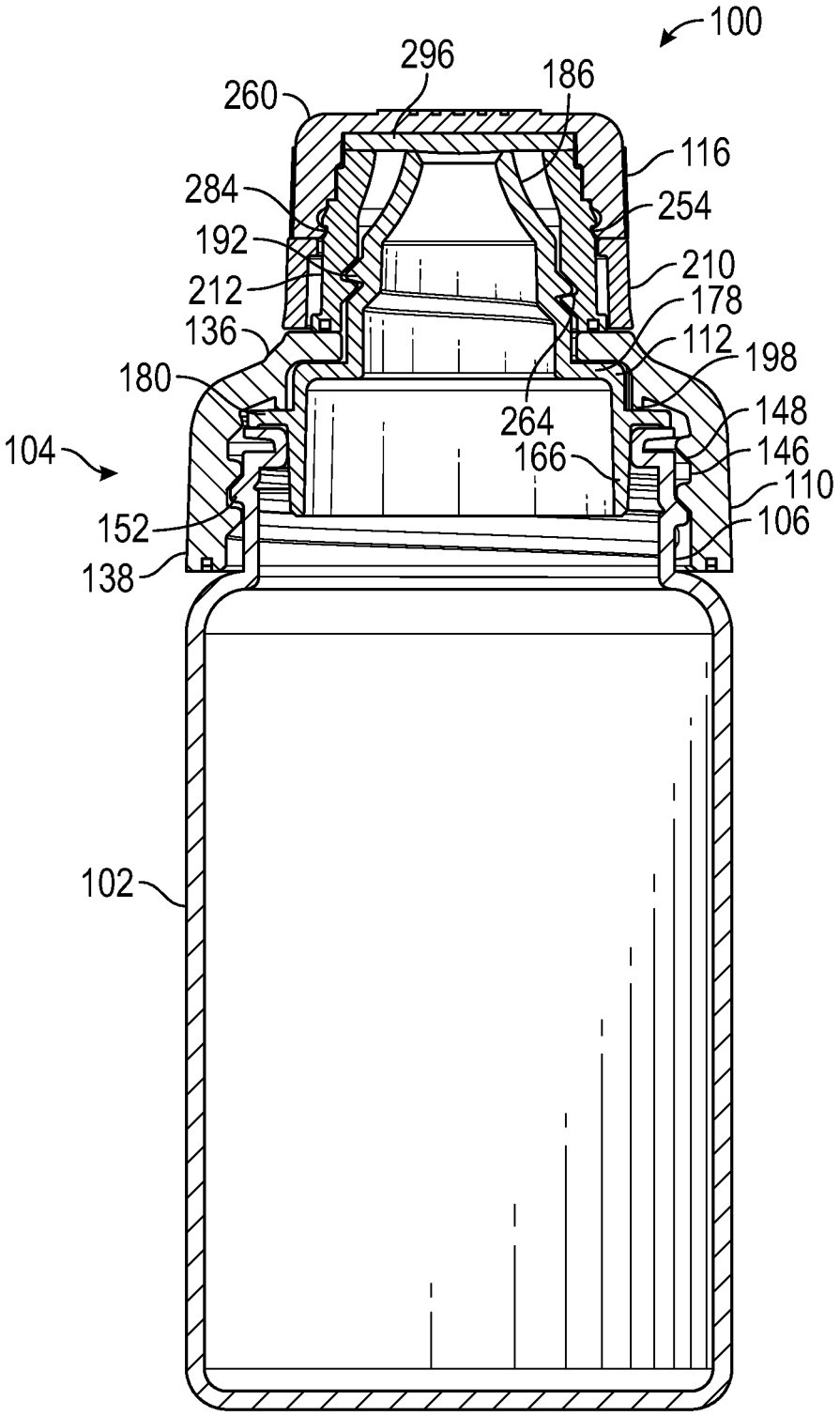
Figure 7:
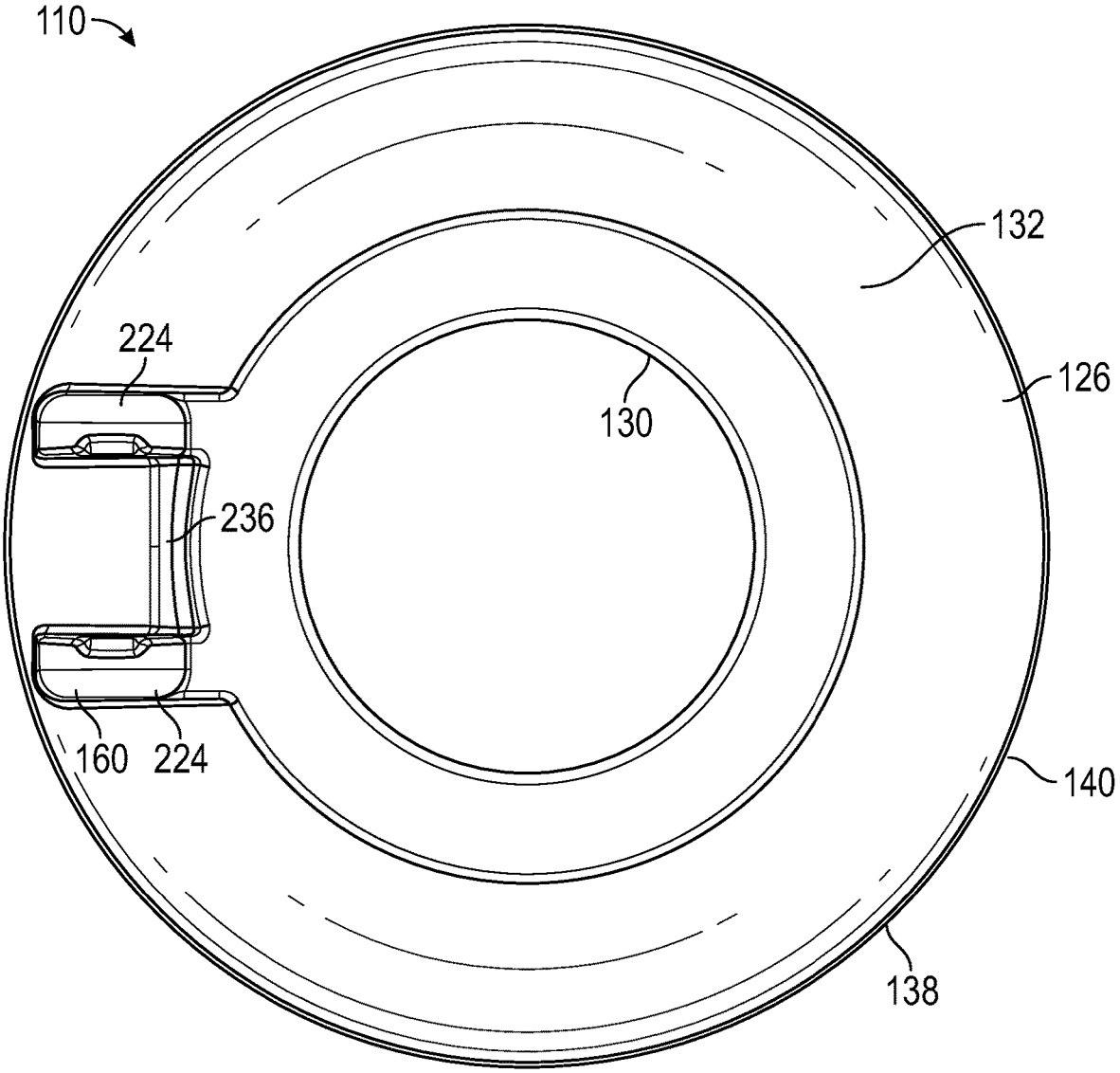
FIG. 7 is a top perspective view of a securing part of the cap assembly.
Figure 8:
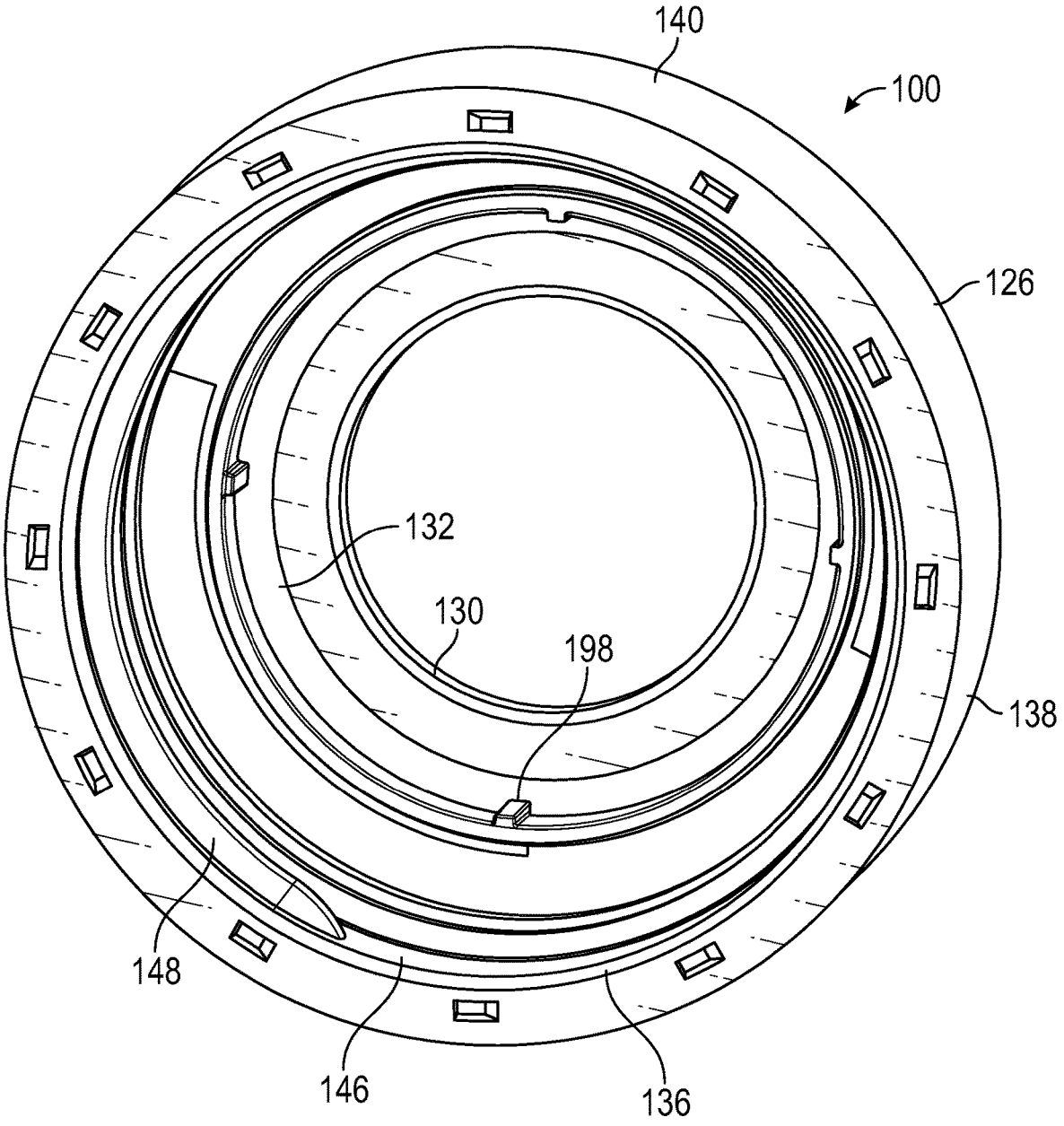
FIG. 8 is a bottom perspective view of the securing part.
Figure 9:
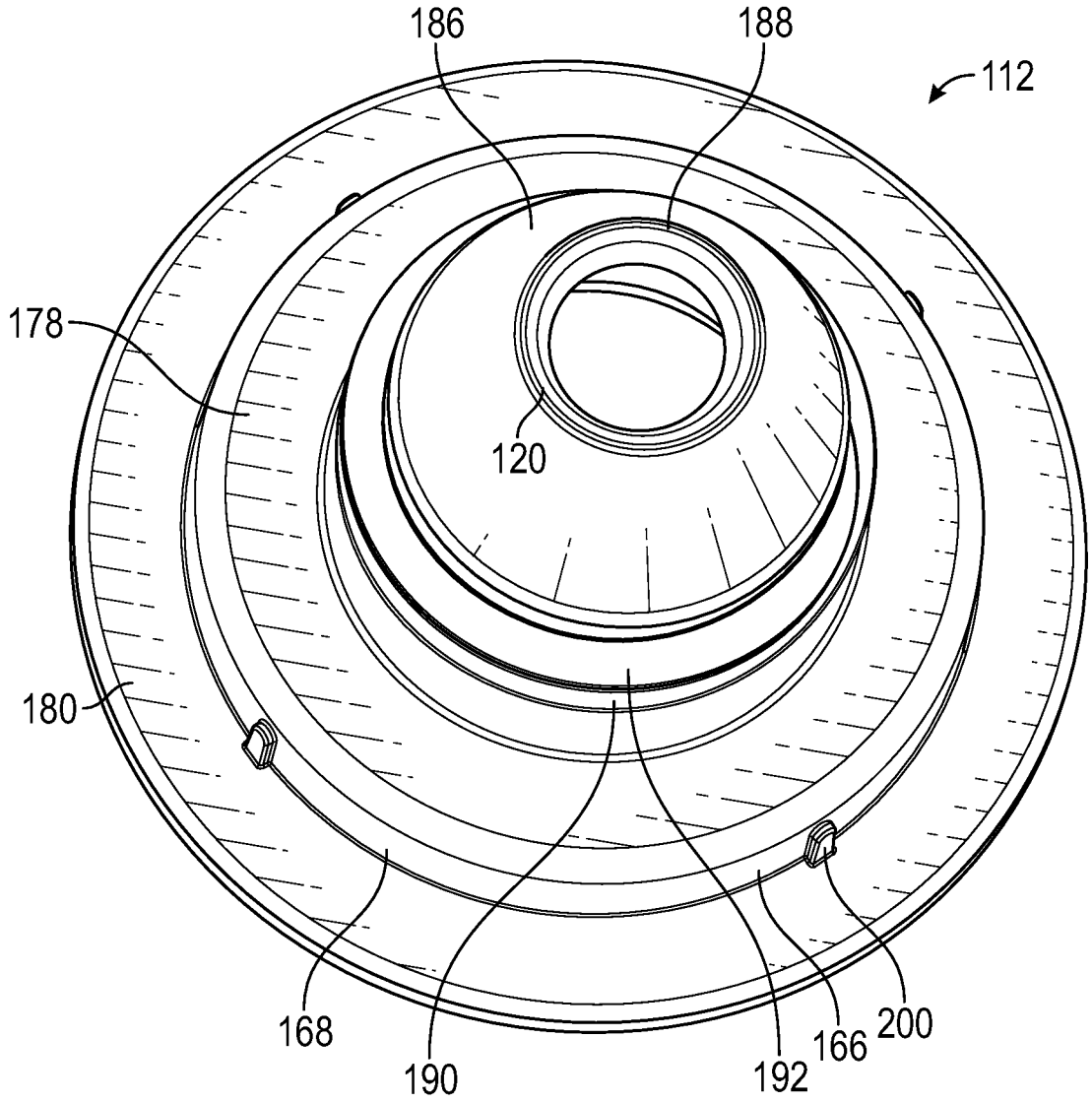
FIG. 9 is a top perspective view of a first nozzle of the condiment bottle.
Figure 13:
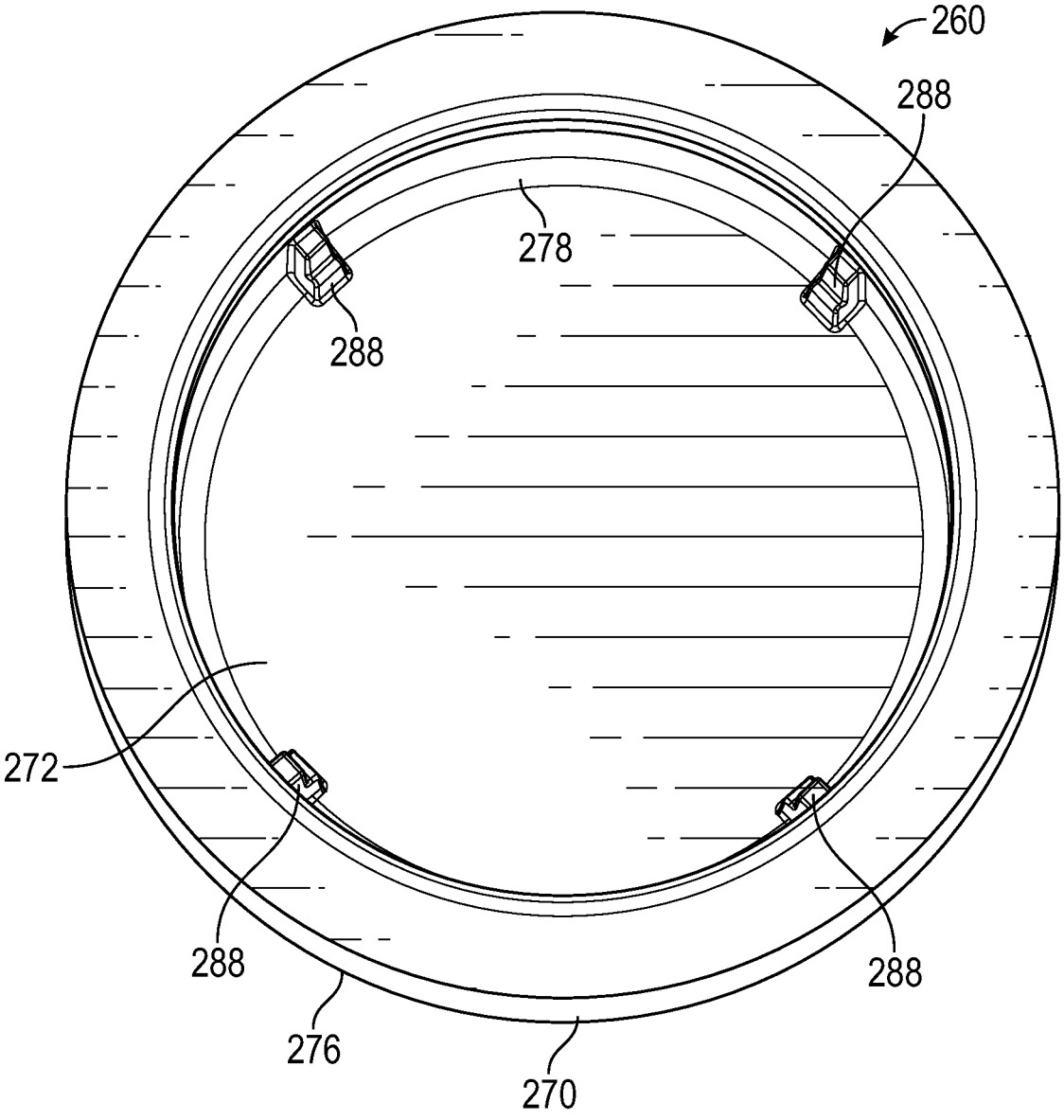
FIG. 13 is a bottom perspective view of a cap of the cap assembly.
Figure 14:
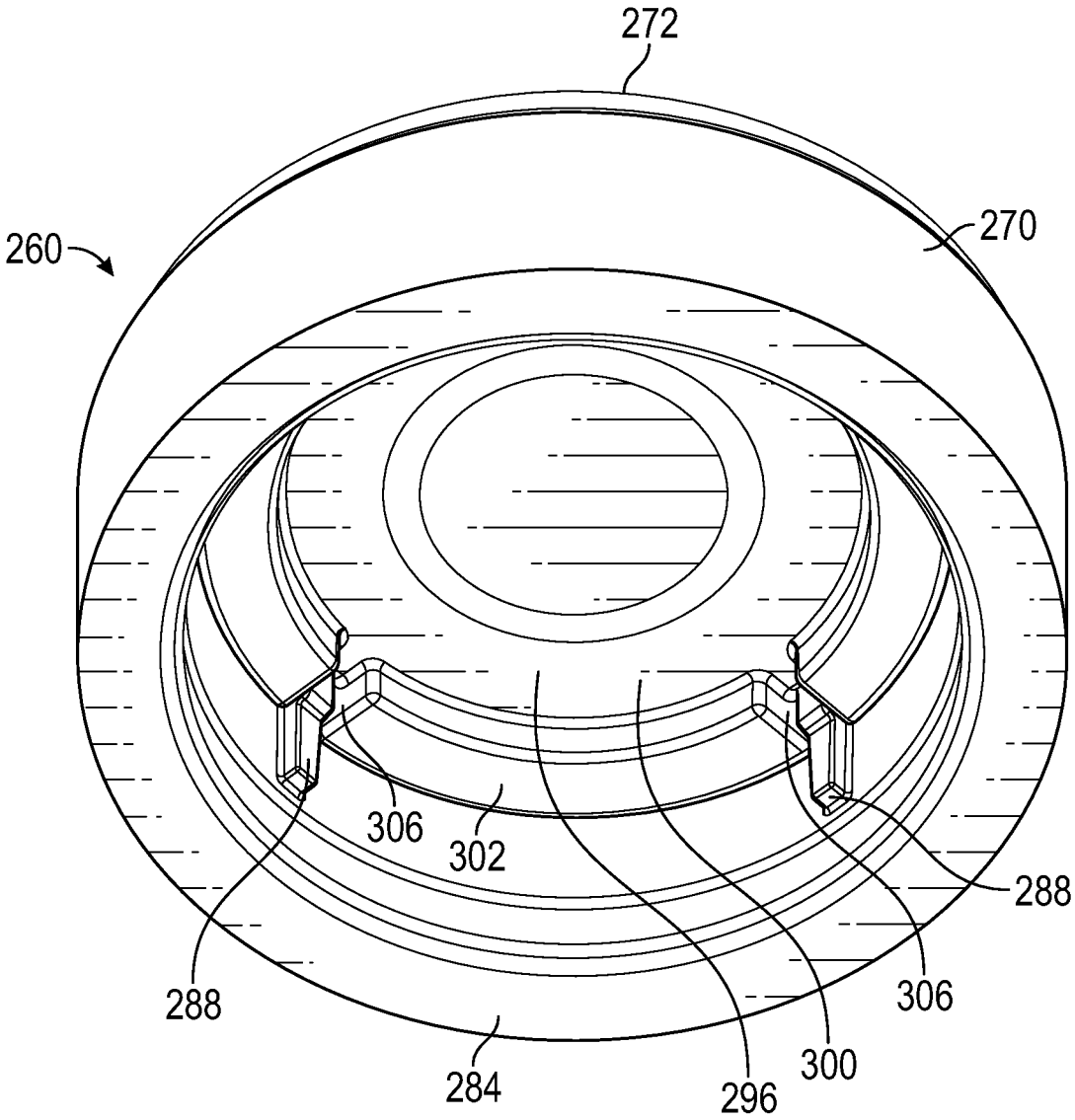
FIG. 14 is a bottom perspective view of the cap with a gasket mounted therein.

The cap 260 secured to the sidewall 244 of the cover 212 is configured to facilitate threaded rotation of the collar 212 on the nozzle 112 between the first position and the second position. In FIG. 13, the cap 260 includes a sidewall 270 and a top wall 272. The sidewall 270 has an outer surface 276 and an inner surface 278. Similar to the outer surface 140 of the securing part 110, the outer surface 276 can be textured (for example, grooved or knurled) to provide for a gripping surface of cap 260. A ledge 284 extends inwardly from an open end of the sidewall 270, the ledge sized to be received in the annular groove 254 of the cover 212 (FIG. 6). Further, to ensure co-rotation of the cap 260 connected to the cover 212, the inner surface 278 of the cap includes a first retaining feature and the outer surface 246 of the cover 212 includes a second retaining feature for engagement with the first retaining feature to hold the cap 260 on the cover 212. In the depicted aspect, the first retaining feature is one of a tab 288 and a notch 290 and the second retaining feature is the other of the tab and the notch, wherein the notch 290 is sized to securely receive the tab 288. As shown, the tab 288 extends from the inner surface 278, and the notch 290 is formed on the outer surface 246. Further, multiple tabs 288 and corresponding notches 290 (for example, the illustrated four tabs and notches) can be provided on the respective cap 260 and cover 212. In addition, the tab 288 and the notch 290 can be substantially wedge shaped to maintain tab 288 within the notch 290 during co-rotation of the cap 260 and the cover 212.

Figure 5:
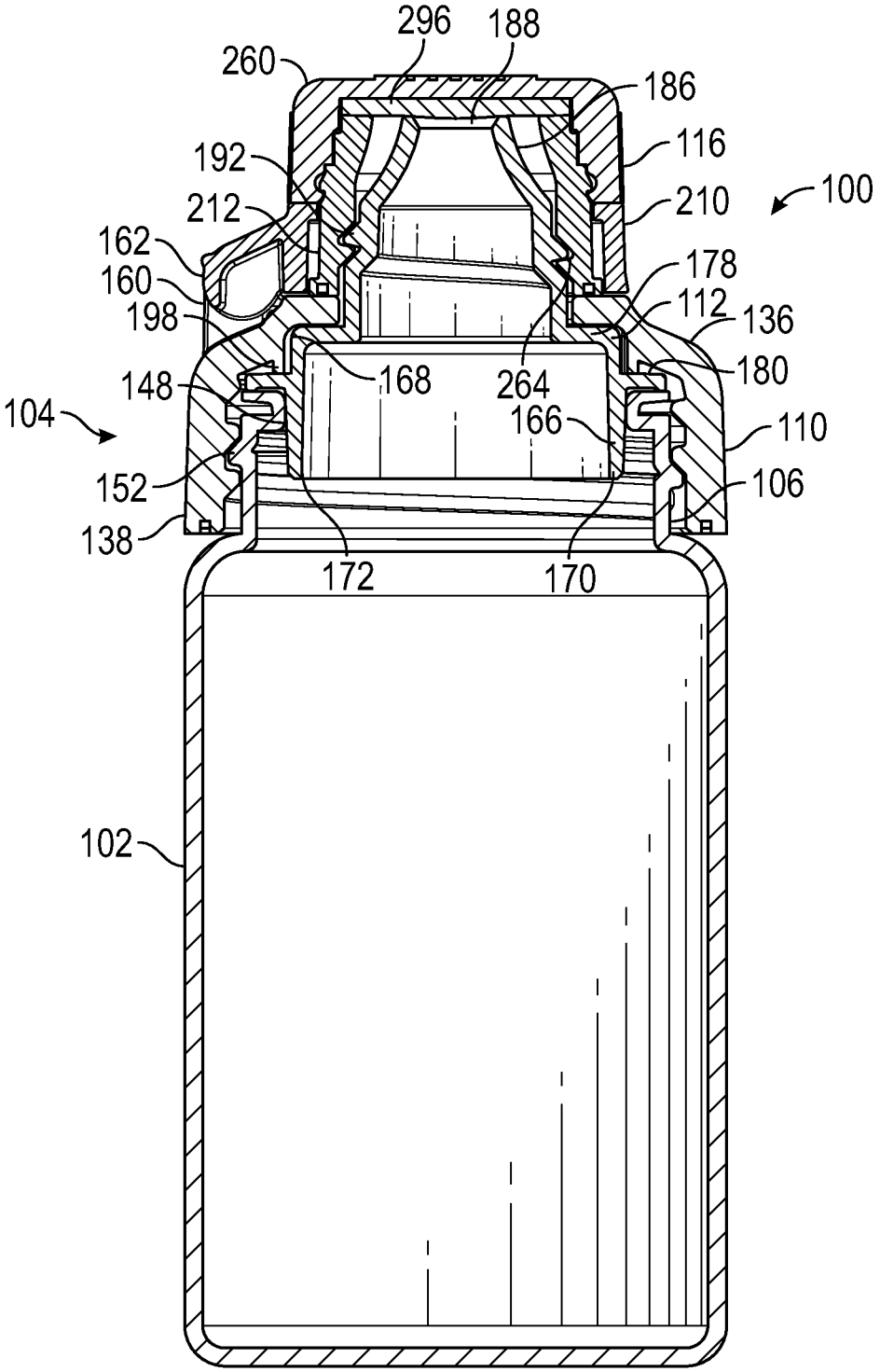
FIGS. 5 and 6 are cross-sectional views of the condiment bottle.

In FIGS. 4-6 and 14, the closure part 116 further includes a sealing member provided on the inner surface of the cap for sealingly engaging the nozzle 112. In the depicted aspect, the sealing member is a gasket 296, which can be separate from the cap 260 and secured to the inner surface of the cap or formed integral with the inner surface of the cap. The depicted gasket 296 is separate from the cap 260 and includes a body 300 with an annular flange 302 located on a lower surface of the body. A cutout or notch 306 is formed in the body 300 and through the flange 302. The notch 306 is sized to receive the tab 288 on the cap 260, and in the depicted aspect four notches 306 are provided to match the four tabs 288 on the cap 260. The notch 306 is further sized to receive a tab 310 formed on an extension 312 of the cover 212. In assembly, the gasket 296 is first fitted onto the tab 288, and the cap 260 is connected to the cover 212 as described above. This connection of the cap to the cover positions the extension 312 within an area defined by the gasket body 300 and flange 302 with the tab 310 also received in the notch 306 of the gasket. With the gasket 296 properly secured between the cap 260 and the cover 212, the gasket 296 seals against the top 120 of the nozzle 112 in the closed position of the closure part 116 (FIGS. 5 and 6).

As is evident from the foregoing, in use, the cover 212 is first unscrewed from the nozzle 112 via rotation of the cap 360, the threaded connection between the nozzle 112 and the cover 212 lifting the cover and cap along the longitudinal axis 118 of the condiment bottle 100. With the cover 212 disconnected from the nozzle 112, the cover and cap can be swung open via the hinged connection between the securing part 110 and the collar 210. The hinged connection is adapted to maintain the flip-over cover 212 and cap 360 in the open position so these components of the cap assembly 104 do not swing back in front of the nozzle 112 during use. Also, in FIGS. 15 and 16 different sized nozzles 112, 112' can be used with the closure part 116.

The present discourse further provides a method of dispensing a substance from a condiment bottle 100. The exemplary method comprises providing a container 102 having a cap assembly 104 associated therewith, wherein the cap assembly 104 includes a securing part 110 connected to the container 104, a nozzle 112 secured by the securing part 110, and a closure part 116 connected to both the securing part 110 and the nozzle 112; moving the closure part 116 axially along a longitudinal axis 118 of the container from a closed position (FIG. 1) of the closure part 116 where the closure part sealingly engages the nozzle 112 to an intermediate position (FIG. 2) of the closure part 112 where the closure part is spaced from and covering the nozzle 112; pivoting the closure part 116 in the intermediate position away from the nozzle 112 to an open position (FIG. 3) where the closure part 116 no longer covers the nozzle; and dispensing the substance through an opening of the nozzle 112.

The closure part 116 includes a collar 210 and a cover 212 secured by the collar, and the exemplary method includes threadingly connecting the cover 212 to the nozzle 112. The exemplary method further comprises hingedly connecting the collar 210 to the securing part 110 allowing for the pivoting of the closure part 116 to the open position. The exemplary method further comprises configuring the hinged connection of the collar 210 and the securing part 110 to maintain the closure part 116 in the open position.

It should be appreciated that the above described parts of the condiment bottle 100 may be constructed of any suitable plastic or may be constructed of any other material in accordance with other embodiments of the present disclosure.

It will also be appreciated that the above-disclosed embodiments and other features and functions, or alternatives or varieties thereof, may be desirably combined into many other different assemblies or applications. Also that various presently unforeseen or unanticipated alternatives, modifications, variations or improvements therein may be subsequently made by those skilled in the art which are also intended to be encompassed by the following claims.

The invention claimed is:

1. A condiment bottle comprising:

a container; and a cap assembly including:

a securing part releasably connected to the container, a nozzle secured to the container by the securing part, and a closure part connected to both the securing part and the nozzle, the closure part configured to move along a longitudinal axis of the condiment bottle from a closed position where the closure part sealingly engages the nozzle to an intermediate position where the closure part is spaced from and covering the top of the nozzle, and the closure part further configured to pivotally move from the intermediate position to an open position where the closure part is located along a sidewall of the nozzle, wherein the closure part includes a cover and a cap secured by the cover to facilitate movement of the cover relative to the nozzle from a first position where the closure part is in the closed position to a second position where the closure part is in the intermediate position.

2. The condiment bottle of claim 1, wherein the closure part includes a collar, the cover is connected to the collar, and the cover is rotatable with respect to the collar about the longitudinal axis.

3. The condiment bottle of claim 2, wherein the nozzle includes an outer wall with an external thread and the cover includes an inner wall with an internal thread for threadingly engaging the external thread of the nozzle, wherein the cover is moveable relative to and along a length direction of the nozzle from a first position where the closure part is in the closed position to a second position where the closure part is in the intermediate position.

4. The condiment bottle of claim 3, wherein the cap is secured to an outer wall of the cover, the cap configured to facilitate threaded rotation of the collar on the nozzle between the first position and the second position.

5. The condiment bottle of claim 4, including a sealing member provided on an inner wall of the cap.

6. The condiment bottle of claim 5, wherein the sealing member is a gasket, the inner wall of the cap includes a tab, and the gasket includes a notch sized to receive the at least one tab.

7. The condiment bottle of claim 4, wherein an inner wall of the cap includes a first retaining feature and the outer wall of the cover includes a second retaining feature for engagement with the first retaining feature to hold the cap on the cover.

8. The condiment bottle of claim 7, wherein the first retaining feature is one of a tab and a notch and the second retaining feature is the other of the tab and the notch, wherein the notch is sized to securely receive the tab.

9. The condiment bottle of claim 4, wherein the collar is hingedly connected to the securing part, and the hinged connection of the collar and the securing part is configured to maintain closure part in the open position.

10. The condiment bottle of claim 1, wherein the nozzle is configured to be secured between a neck portion of the container and the securing part.

11. The condiment bottle of claim 1, wherein the closure part includes a collar hingedly connected to the securing part and the cover is secured by the collar.

12. The condiment bottle of claim 1, wherein the nozzle is selected from one of a first nozzle having a first sized head part and a second nozzle have a second sized head part that is smaller than the first sized head part.

13. A method of dispensing a substance from a container, the method comprising:

providing a container having a cap assembly associated therewith, wherein the cap assembly includes a securing part connected to the container, a nozzle secured by the securing part, and a closure part connected to both the securing part and the nozzle;

moving the closure part axially along a longitudinal axis of the container from a closed position of the closure part where the closure part sealingly engages the nozzle to an intermediate position of the closure part where the closure part is spaced from and covering the nozzle; and pivoting the closure part in the intermediate position away from the nozzle to an open position where the closure part no longer covers the nozzle, wherein the closure part includes a cover and a cap, and the method includes connecting the cap to the cover to facilitate movement of the cover relative to the nozzle from a first position where the closure part is in the closed position to a second position where the closure part is in the intermediate position.

14. The method of claim 13, wherein the closure part includes a collar, the cover is secured by the collar, and the method includes threadingly connecting the cover to the nozzle.

15. The method of claim 14, including hingedly connecting the collar to the securing part allowing for the pivoting of the closure part to the open position.

16. The method of claim 15, including configuring the hinged connection of the collar and the securing part to maintain the closure part in the open position.

17. A condiment bottle comprising:

a container; and a cap assembly including:

a securing part releasably connected to the container, a nozzle secured to the container by the securing part, and a closure part connected to both the securing part and the nozzle, the closure part configured to move along a longitudinal axis of the condiment bottle from a closed position where the closure part sealingly engages the nozzle to an intermediate position where the closure part is spaced from and covering the nozzle, and the closure part further configured to pivotally move from the intermediate position to an open position where the closure part no longer covers the nozzle, wherein the closure part includes a collar hingedly connected to the securing part, a cover secured by the collar, and a cap secured by and covering the cover, the cover movable along the longitudinal axis from a first position where the closure part is in the closed position to a second position where the closure part is in the intermediate position.

18. The condiment bottle of claim 17, wherein the collar is hingedly connected to the securing part, and the hinged connection of the collar and the securing part is configured to maintain closure part in the open position.

* * * * *